US008383942B2

(12) United States Patent
Hsieh et al.

(10) Patent No.: US 8,383,942 B2
(45) Date of Patent: Feb. 26, 2013

(54) CONNECTING MEMBER

(75) Inventors: Chung-Cheng Hsieh, Taipei Hsien (TW); Li-Ping Chen, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 280 days.

(21) Appl. No.: 12/900,633

(22) Filed: Oct. 8, 2010

(65) Prior Publication Data

US 2011/0287660 A1 Nov. 24, 2011

(30) Foreign Application Priority Data

May 24, 2010 (CN) ..... 2010 1 0181018

(51) Int. Cl.
*H01B 7/06* (2006.01)

(52) U.S. Cl. ..... 174/69

(58) Field of Classification Search ..... 439/502; 174/69, 135

See application file for complete search history.

(56) References Cited

U.S. PATENT DOCUMENTS

| | | | | | |
|---|---|---|---|---|---|
| 1,812,518 | A * | 6/1931 | Druppel | 248/51 |
| 2,052,341 | A * | 8/1936 | Douglass | 242/378.3 |
| 2,143,649 | A * | 1/1939 | Dansard | 174/69 |
| 3,027,417 | A * | 3/1962 | Turner, Jr. | 174/69 |
| 3,037,068 | A * | 5/1962 | Wessel | 174/69 |
| 3,300,572 | A * | 1/1967 | Dahlgren et al. | 174/69 |
| 3,399,909 | A * | 9/1968 | Ambrose | 285/61 |
| 3,818,122 | A * | 6/1974 | Luetzow | 174/86 |
| 4,475,141 | A * | 10/1984 | Antonevich | 361/220 |
| 4,992,629 | A * | 2/1991 | Morais | 174/69 |
| 5,175,398 | A * | 12/1992 | Hofmann | 174/169 |
| 5,341,806 | A * | 8/1994 | Gadsby et al. | 600/393 |
| 5,495,076 | A * | 2/1996 | Davis | 174/254 |
| 5,556,059 | A * | 9/1996 | Maeda et al. | 248/49 |
| 5,816,848 | A * | 10/1998 | Zimmerman | 439/502 |
| 5,906,507 | A * | 5/1999 | Howard | 439/501 |
| 6,293,803 | B1 * | 9/2001 | Rust et al. | 439/33 |
| 6,315,575 | B1 * | 11/2001 | Kajimoto | 439/33 |
| 6,319,012 | B1 * | 11/2001 | Moessinger et al. | 439/33 |
| 6,646,207 | B1 * | 11/2003 | Featherstone, III | 174/117 F |
| 7,053,304 | B2 * | 5/2006 | Ojima et al. | 174/72 A |
| 7,140,910 | B1 * | 11/2006 | Liao | 439/502 |
| 7,337,012 | B2 * | 2/2008 | Maghribi et al. | 607/152 |
| 7,488,199 | B2 * | 2/2009 | Gonzalez | 439/502 |
| 7,529,100 | B2 * | 5/2009 | Chuang et al. | 361/749 |
| 7,641,488 | B2 * | 1/2010 | Ho et al. | 439/162 |
| 7,795,540 | B2 * | 9/2010 | Yamada et al. | 174/117 R |
| 8,003,887 | B1 * | 8/2011 | Hsieh et al. | 174/69 |
| 8,106,301 | B2 * | 1/2012 | Hsieh et al. | 174/135 |
| 8,215,967 | B2 * | 7/2012 | Hsieh et al. | 439/67 |
| 2011/0065319 | A1 * | 3/2011 | Oster et al. | 439/586 |
| 2011/0287660 | A1 * | 11/2011 | Hsieh et al. | 439/502 |
| 2011/0297416 | A1 * | 12/2011 | Hsieh et al. | 174/69 |

FOREIGN PATENT DOCUMENTS

JP 5-166049 * 7/1993

* cited by examiner

*Primary Examiner* — Neil Abrams
(74) *Attorney, Agent, or Firm* — Altis Law Group, Inc.

(57) ABSTRACT

A connecting member includes a cable configured to transfer signal, and a resilient component secured to the cable. The cable includes a first connector and a second connector for being electronically connected to two electronic components. The resilient component is elastically deformable between a first state, in which the resilient component and the cable are contracted, spiraled about the second connector in a first direction up to the first connector, shortening a distance between the first and second connectors, and a second state, in which the resilient component and the cable are pulled away from the first connector, thus a greater distance between the first and second connectors.

15 Claims, 3 Drawing Sheets

CONNECTING MEMBER

CROSS-REFERENCE TO RELATED APPLICATIONS

This application are related to co-pending applications entitled, "CONNECTING MEMBER", filed on Sep. 15, 2010, application Ser. No. 12/882,602, and "CONNECTING MEMBER", filed on Sep. 15, 2010, application Ser. No. 12/882,572.

BACKGROUND

1. Technical Field

The present disclosure relates to a connecting member for connecting two electronic components.

2. Description of Related Art

Generally, a cable is configured for connecting electronic components, such as a hard disk drive, a motherboard, or an optical disk drive. The cable normally has a surplus portion when connected to the electronic components in order to assure that the different distances between each component can be met. The surplus portion of the cable takes up a lot of space between the electronic components and is usually disorderly placed in the electronic device.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
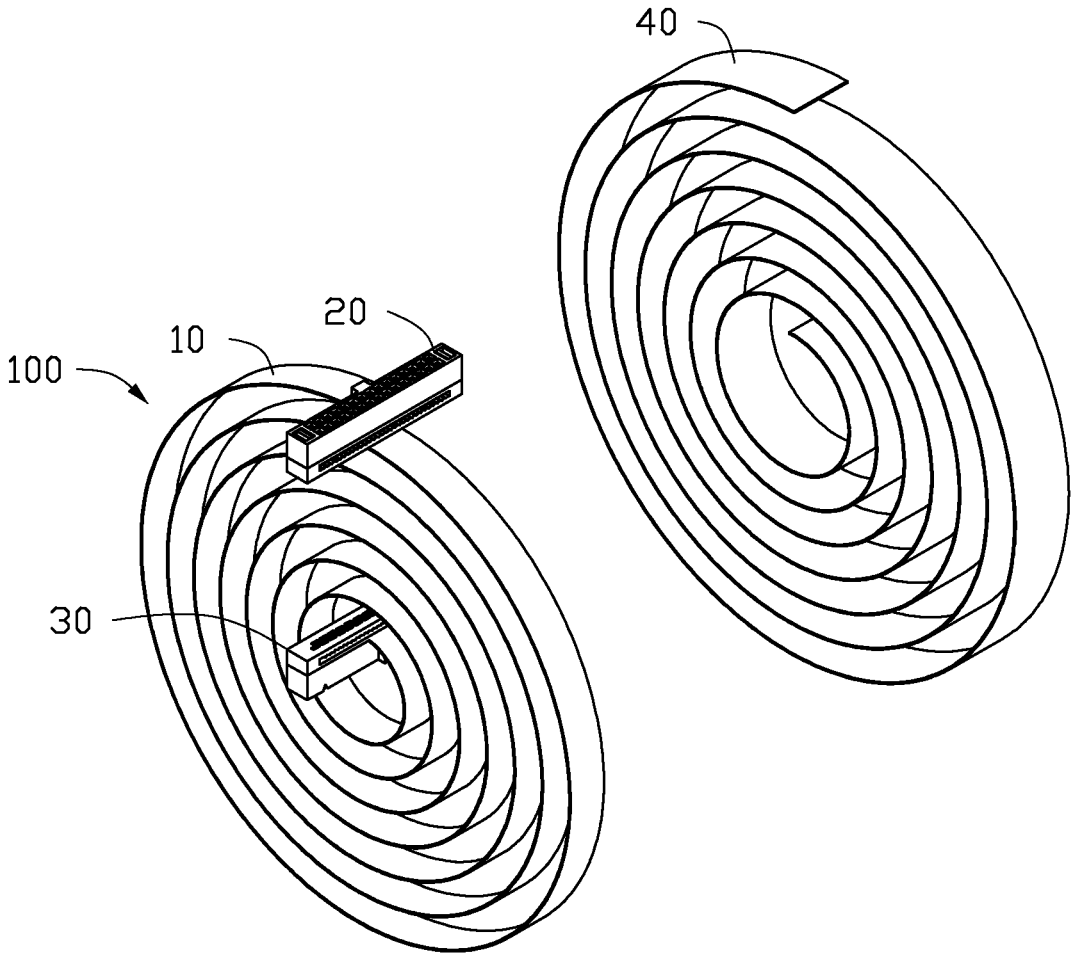
FIG. 1 is a partially exploded, isometric view of a connecting member in accordance with an embodiment.

Referring to FIG. 1, a connecting member in accordance with an exemplary embodiment includes a cable 100 and a resilient component 40.

The cable 100 connects two electronic components of an electronic device (not shown) and transfers signals between the two electronic components. The cable 100 includes a cable body 10, a first connector 20 and a second connector 30 respectively secured to the two ends of the cable body 10. In one embodiment, the electronic device can be a computer or a server, the electronic component can be a storage device, or a motherboard, and the cable 100 can be a ribbon cable.

Figure 2:
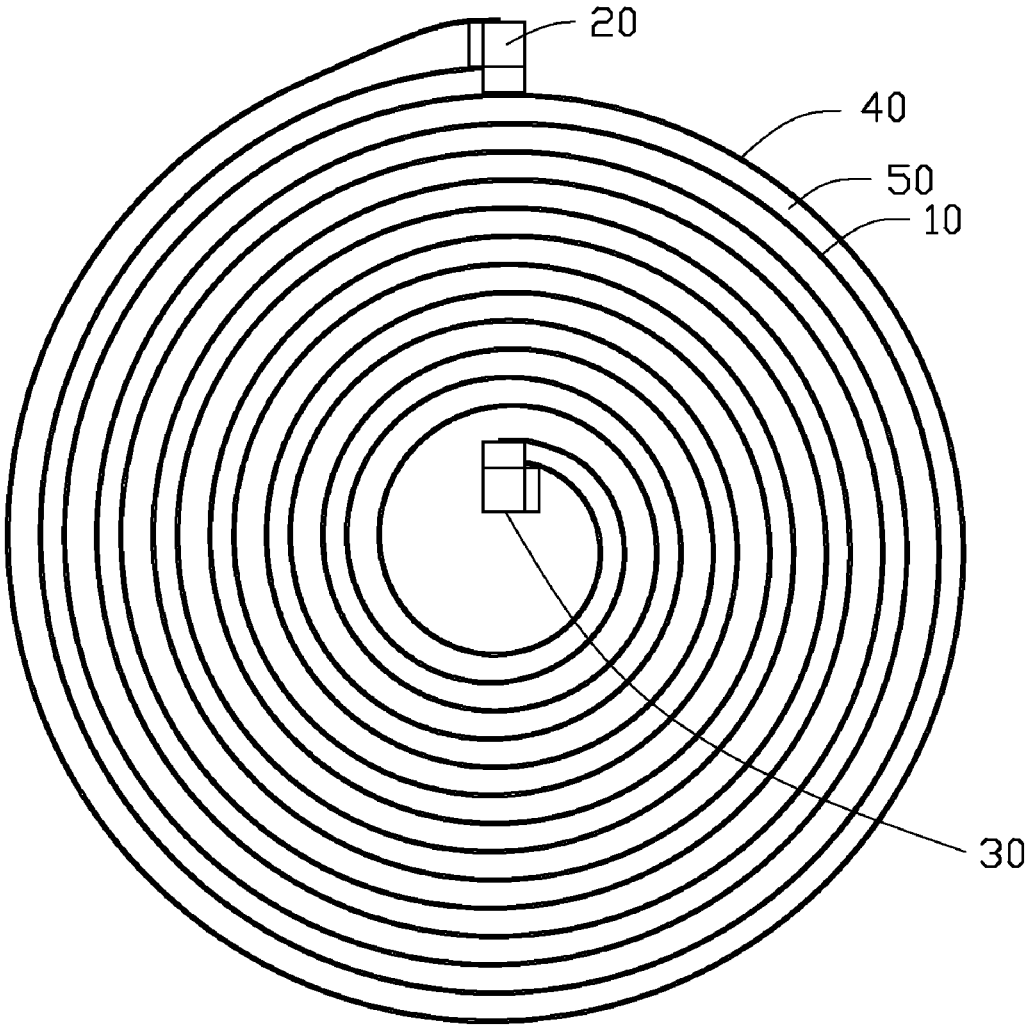
FIG. 2 is an assembled view of FIG. 1, showing the connecting member in a first state.
Figure 3:
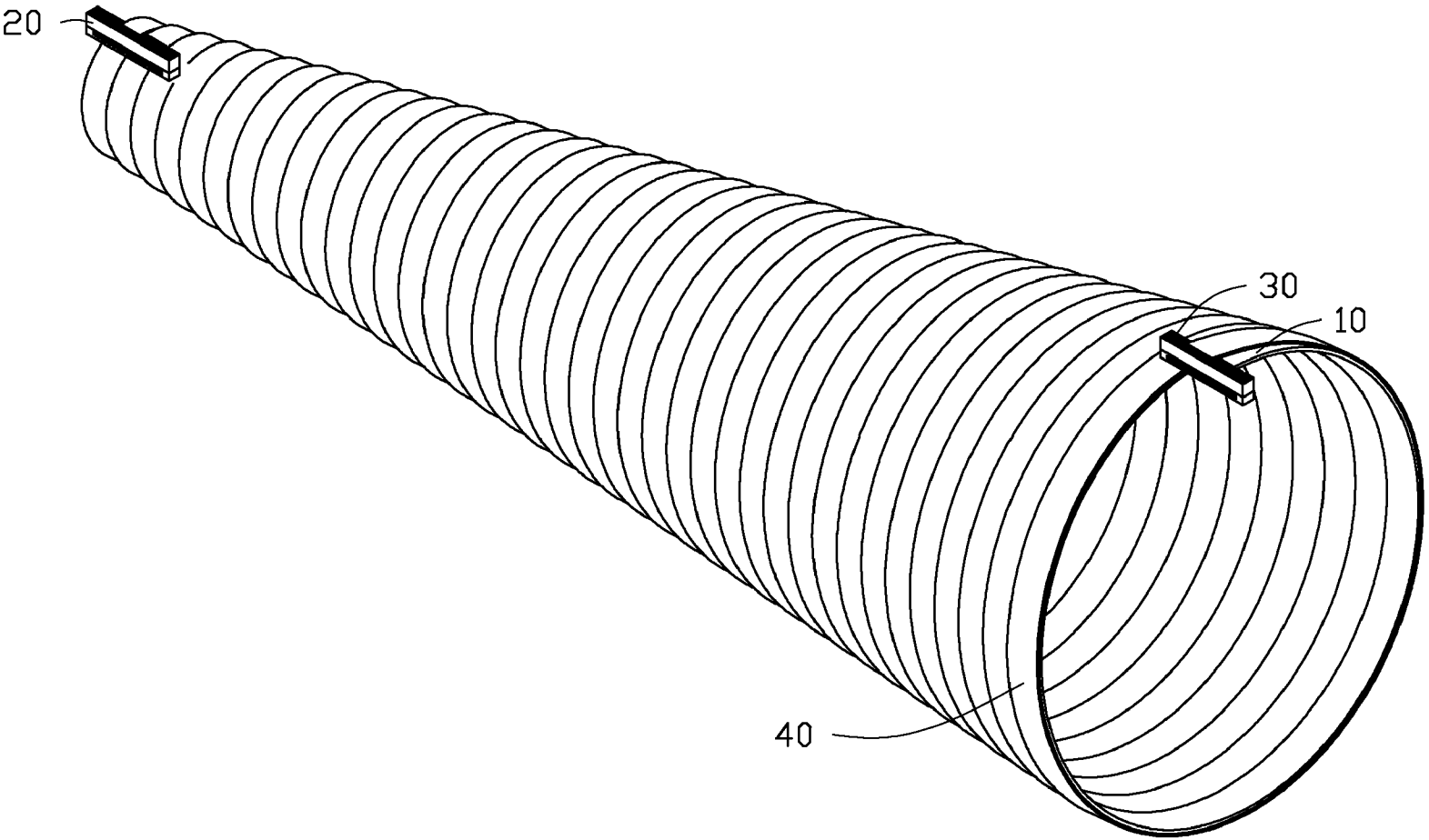
FIG. 3 is similar to FIG. 2, but shows the connecting member in a second state.

Referring to FIGS. 2 and 3, an end of the resilient component 40 is secured to the first connector 20, and the other end of the resilient component 40 is secured to the second connector 30. In one embodiment, a first end of the resilient component 40 is secured to the first connector 20, and a second end of the resilient component 40 is secured to the second connector 30.

The resilient component 40 is elastically distortable between a first state and a second state. In the first state, the resilient component 40 is spiraled about the second connector 30 in a first direction up to the first connector 20. The resilient component 40 is encircled outside of the cable body 10 in a second direction, and a space 50 (shown in FIG. 2) is defined between the resilient component 40 and the cable body 10. In one embodiment, the first direction is a clockwise direction, and the second direction is the same. In this first state, the resilient component 40 is contracted, thereby shortening the cable 100, to decrease the distance between the first and second connectors 20 and 30.

In the second state, the resilient component 40 is elastically extended when the cable 100 is pulled, allowing for more distance between the first and second connectors 20 and 30. In one embodiment, the resilient component 50 is an extendable elastic piece and substantially spiral shaped. The cable 10 is capable of being spiral shaped with the resilient component 50. The width of the resilient component 40 is can be larger than, or can be equal to the width of the cable 10, and the length of the resilient component 40 is substantially equal to the length of the cable 10. In another embodiment, the width and length of the resilient component 40 adjusted according to the width and length of the cable 10.

In use, the first and second connectors 20 and 30 on the cable 10 are connected to two electronic components in a electronic device enclosure (not shown), such as a motherboard, a storage device. To test if the electronic component woks, the electronic component is removed from the electronic device enclosure, so the electronic component can be tested. At this time, the second connector 30 is pulled from the first connector 20, to the second state. In the second state, the resilient component 40 becomes a substantially cone shape. When the electronic component is placed back in the electronic device enclosure, the resilient component 40 contracts, to urge the cable 10 to contract as well. Thus, the cable 10 is capable of being contracted, and can be placed orderly between the two electronic components, to take up less space in the electronic device.

In addition, the cable 100 is capable of stretching and constricting with the resilient component 40 that is circled about the cable 100. Therefore, the cable 100 is not easily damaged when the first and second connectors 20 and 30 are connected to the electronic components. The cable 100 is placed orderly between the electronic components in an enclosure (not shown), and will have less influence on the air flow in the enclosure.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A connecting member comprising:

a cable configured to transmit signals, the cable comprising a first connector and a second connector for being electronically connected to two electronic components; and an resilient component secured to the cable; wherein the resilient component is elastically deformable between a first state, in which the resilient component and the cable are contracted, spiraled about the second connector in a first direction up to the first connector, shortening a distance between the first and second connectors, and a second state, in which the resilient component and the cable are pulled away from the first connector, thus a greater distance between the first and second connectors.

2. The connecting member of claim 1, wherein the cable further comprises a cable body, and the first and second connectors are electronically connected to the cable body.

3. The connecting member of claim 1, wherein the cable is spiraled about the second connector in a clockwise direction, and the resilient component is encircled outside of the cable body.

4. The connecting member of claim 2, wherein a space is defined between the resilient component and the cable.

5. The connecting member of claim 1, wherein an end of the resilient component is secured to the first connector, and another end of the resilient component is secured to the second connector.

6. The connecting member of claim 2, wherein the length of the resilient component is longer than the length of the cable body.

7. The connecting member of claim 2, wherein the width of the resilient component is larger than, or equal to the width of the cable body.

8. The connecting member of claim 1, wherein the resilient component is an extendable elastic piece.

9. The connecting member of claim 8, wherein the extendable elastic piece is biased towards a spiral shape.

10. The connecting member of claim 9, wherein the extendable elastic piece and the cable are cone shaped in the second state.

11. A connecting member comprising:

a cable configured to transmit signals, the cable comprising a first connector and a second connector for being electronically connected to two electronic components; and a spiral shaped resilient component secured to the first connector and the second connector, wherein the cable is capable of positioning in the spiral shaped resilient component, the spiral shaped resilient component and the cable are spiraled about the second connector in a same direction up to the first connector.

12. The connecting member of claim 11, wherein the cable further comprises a cable body, and the first and second connectors are electronically connected to two ends of the cable body.

13. The connecting member of claim 12, wherein a space is defined between the spiral shaped resilient component and the cable body.

14. The connecting member of claim 12, wherein the length of the spiral shaped resilient component is longer than the length of the cable body.

15. The connecting member of claim 12, wherein the width of the spiral shaped resilient component is larger than, or equal to the width of the cable body.

* * * * *